US005702119A

United States Patent [19]

Challande et al.

[11] Patent Number: 5,702,119

[45] Date of Patent: Dec. 30, 1997

[54] BOOT AND RETENTION ELEMENT ASSEMBLY ADAPTED FOR SKIING

[75] Inventors: Christian Challande, Cruseilles; Pierre Desarmaux, Evires; Pascal Thomas, Chambery, all of France

[73] Assignee: Salomon S.A., Metz-Tessy, France

[21] Appl. No.: 501,797

[22] Filed: Jul. 13, 1995

[30] Foreign Application Priority Data

Jul. 13, 1994 [FR] France ..... 94 08943

[51] Int. Cl.[6] ..... A63C 9/085

[52] U.S. Cl. ..... 280/625; 280/634; 36/117.3

[58] Field of Search ..... 280/611, 613, 280/623, 624, 625, 626, 628, 632, 634, 635; 36/117.1, 117.4, 117.3

[56] References Cited

U.S. PATENT DOCUMENTS

| | | | |
|---|---|---|---|
| 4,410,199 | 10/1983 | Eisenberg | 280/635 |
| 4,543,738 | 10/1985 | Mower | 36/117 |
| 5,016,902 | 5/1991 | Goud et al. | 280/625 |
| 5,333,891 | 8/1994 | Stritzl et al. | 280/625 |
| 5,333,892 | 8/1994 | Stritzl et al. | 280/625 |

FOREIGN PATENT DOCUMENTS

| | | | |
|---|---|---|---|
| 1503847 | 12/1967 | France . | |
| 1503848 | 12/1967 | France . | |
| 1503849 | 12/1967 | France . | |
| 2419737 | 10/1979 | France | A63C 9/085 |
| 2463629 | 2/1981 | France | A63C 9/10 |
| 2517214 | 6/1983 | France . | |
| 2640516 | 6/1990 | France | A63C 9/08 |
| 1807074 | 5/1970 | Germany | A63C 9/08 |
| 2449514 | 4/1976 | Germany | A43B 5/04 |
| 2802251 | 7/1979 | Germany | A63C 9/085 |
| 4305327 | 3/1994 | Germany | A63C 9/084 |

*Primary Examiner*—Richard M. Camby
*Attorney, Agent, or Firm*—Greenblum & Bernstein P.L.C.

[57] ABSTRACT

The invention relates to an assembly of a boot and a retention element of the ski boot. The boot has at the level of its tip a local asymmetry, that the retention element has a specific and symmetrical elastic retention element adapted to cooperate with the asymmetric zone in a manner such that the boot is freed more easily on one side than on the other. The invention relates also to a retention element and a boot considered alone, and to a pair of boots whose tips are symmetrical to one another.

26 Claims, 6 Drawing Sheets

BOOT AND RETENTION ELEMENT ASSEMBLY ADAPTED FOR SKIING

BACKGROUND OF THE INVENTION

1. Field of the Invention

The present invention relates to an assembly of a boot or shoe and a retention element adapted to retain the leg of an athlete on a gliding board, and in particular that of a skier on a ski.

The invention relates likewise to a boot or shoe and a retention element of this assembly taken individually.

2. Description of Background and Material Information

In the case of alpine skiing, it is known to retain a boot supported on the ski by means of a binding or by a front binding or retention element and a rear binding or retention element which retain the front and rear tips of the boot. These two binding elements comprise a jaw carried by a body. The jaw is movable in response to biases of the boot against the return force of a spring which opposes its displacement.

The rigidity of the spring is adjustable, in a manner such that the boot be released from the binding element in the case of a bias exceeding a predetermined bias threshold. This threshold is conventionally referred to as a release threshold.

In order to be able to utilize boots with different binding or retention elements of the market, the form of the front and rear tips of the boot has been standardized. In the ISO standardization system, the standard in effect is referred to as ISO 5355. The binding elements, as to themselves, are adapted to be compatible with standardized zones of the boot and to assure the release of the boot at predetermined release values.

In front, a boot is retained by a front binding element whose jaw is movable at least laterally towards the interior or exterior of the foot, which corresponds to a torsional bias. Conventional bindings have a release threshold which is generally equal with regard to release movements directed towards the interior and the exterior of the foot.

Yet, it is known that the knee of the skier which is biased during a fall in torsion is more fragile with respect to a rotation of the foot towards the interior as opposed to a rotation towards the exterior.

To take this into account, binding elements have been proposed which have a different release threshold depending upon the direction of rocking of the jaw. For example, such elements are described in French Patents 1503847, 1503848, and 1503849, and further in published German Paten Application No. 1807074.

The major disadvantage of this type of apparatus is that it requires a pairing between the boots and the skis, i.e., that the right ski and left ski must necessarily be identified as such, and the skier must above all use the right ski with the right boot and the left ski with the left boot. The skier must under no circumstances reverse the skis and put them on the wrong foot, otherwise, the reverse effect is obtained. This problem results also due to the fact that according to the standard, the tips of the boots are symmetrical with respect to a vertical median plane, and that as a result, there is a priori no necessity of distinguishing and identifying the right ski and the left ski. It is thus for the skier to pay attention to which ski the skier puts on which foot.

SUMMARY OF THE INVENTION

An object of the invention is to further improve the protection provided to the skier. It comprises perfecting this variable threshold release affect as a function of the direction of bias during torsion.

According to the solution proposed by the invention, this affect is obtained regardless of which ski is put on which foot.

This problem is resolved by the assembly of a boot and a binding element such as claimed.

It is also resolved by the binding element such as it is defined and claimed, by the boot as it is defined and claimed and by the pair of boots described and claimed.

The boot locally presents an asymmetrical form, and the retention element has a specific symmetric retention means which is adapted to cooperate with the asymmetric shape of the boot. It is as a result of this cooperation that the release threshold is different depending upon the direction in which the boot biases the retention element.

The asymmetrical form of the boot is for example a curve of the edge of the sole or a shoulder with which an elastic finger of the retention element which is biased by a spring cooperates.

According to another way of performing the invention, the retention element has a retention jaw having two stages, a lower stage for gripping a sole and an upper stage for gripping a vamp, and the boot has a sole or a vamp of which one of the lateral sides has been reduced. The boot is supported against the jaw on one side on the vamp and on the other side on the sole.

BRIEF DESCRIPTION OF THE DRAWINGS

The invention will be better understood with reference to the description which follows and the annexed drawings forming an integral part of the invention, in which.

DETAILED DESCRIPTION

Figure 1:
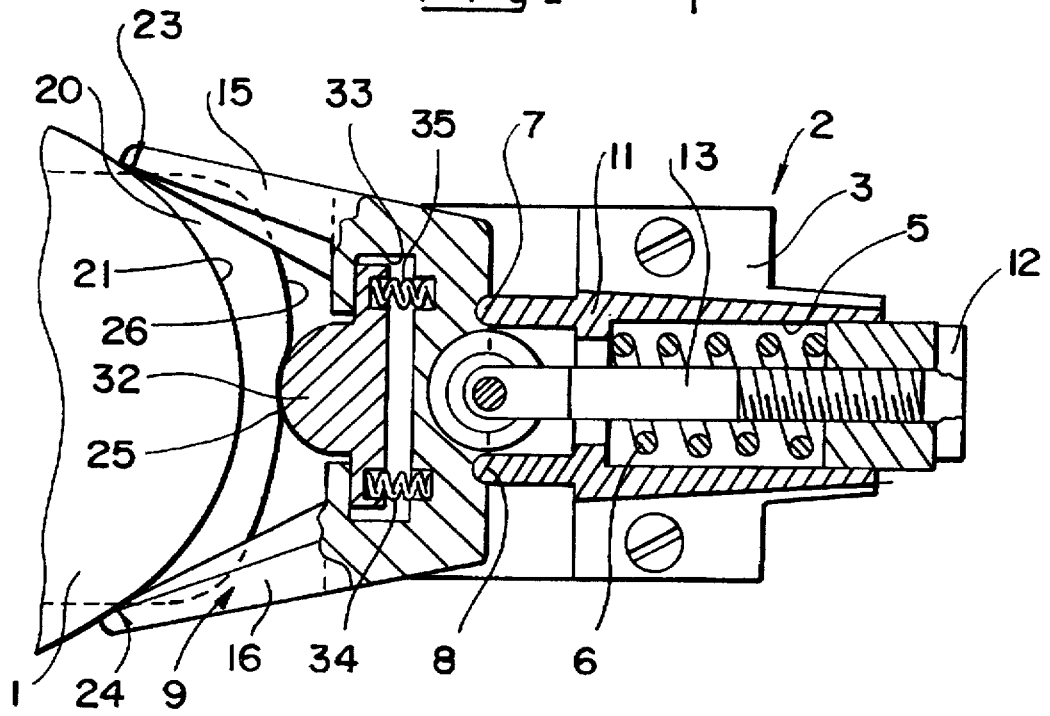
FIG. 1 illustrates a top view and in partial cross section the front of a boot and a front retention element according to a first way of performing the invention.
Figure 2:
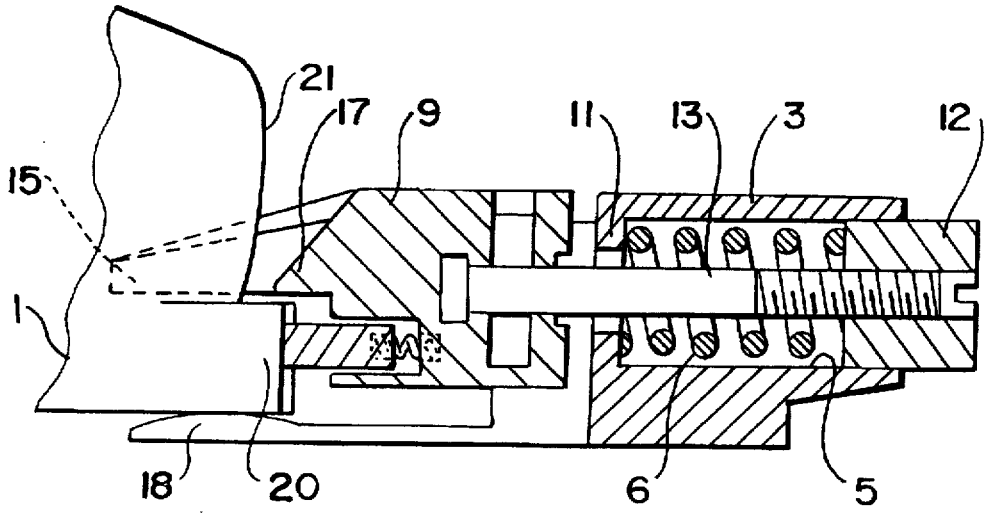
FIG. 2 is a side view in partial cross section of the assembly formed by the boot and the retention element shown in FIG. 1.

FIG. 1 illustrates in top view the front portion of a boot 1 engaged in a front retention element 2. The retention element shown is known in large portion from published French Patent Application No. 2419737.

This element 2 comprises a body is adapted to the solidly affixed to the ski. The body has an internal seat 5 in which is positioned a spring 6. In its rear surface, the body has two support zones 7 and 8 against which the spring applies in an elastic fashion a retention jaw 9. The rear end of the spring is in effect supported against a wall 11 of the body, and its front end is supported against a cap 12 slidably guided within the seat, and connected to the jaw by means of a tie rod 13 which extends through the rear surface of the body.

In a known manner, the jaw is monoblock and has two wings 15 and 16 for lateral retention, as well as a sole grip 17 for vertical retention.

The jaw rests on the body at two zones 7 and 8. It can pivot around one or the other of these zones, which causes the displacement of the tie rod towards the rear, to which the spring elastically opposes by compressing itself. If the pivoting of the jaw is sufficient, it allows the end of the boot to escape. This results in release of the boot. The threshold force that the boot must overcome in order to be released is commonly referred to as a release threshold. It depends principally on the rigidity of the spring and its initial compression, which in the present case is adjustable by tightening cap 12 positioned in front of the tie rod.

The retention element furthermore has a support plate 18 upon which rests the sole of the boot.

In a known manner, the front of the boot 1 has a linkage tip with jaw 9. This tip is in two parts, a lower sole portion 20 and an upper vamp portion 21.

In the embodiments shown, jaw 9 retains the boot by a grip on the vamp, i.e., that the lateral retention of the boot occurs at the level of the vamp.

In a centered position of the jaw, i.e., a position aligned with the longitudinal and vertical median plane defined by the ski, the jaw has two principal zones 23 and 24 of contact with the jaw, which assures the linkage in a horizontal plane between the boot and the jaw.

A third contact zone 25 is provided at the level of the sole. This zone is positioned immediately adjacent to the median plane. This zone furthermore has an asymmetry. In FIG. 1, it can visibly be seen that the left part of the sole of the boot has on its front surface a slightly wavy form 26 resulting from a localized extension of the sole, with respect to the right portion.

Curve 26 is provided to cooperate with an elastic retention means of the retention element. This means is formed by a central support projection 32 which is movable and which is seated in a cut-out 33 of the jaw, and elastically pushes towards the rear by two parallel springs 34 and 35. Under the action of springs 34 and 35, the projection is supported by lateral shoulders against the rear wall of opening 33 that the central portion of projection 32 extends through.

Curve 26 of the boot is slightly offset from the left side of the boot to rest against the left side of projection 32.

One thus understands that if the boot biases the retention jaw from the right side, i.e., towards the bottom on the figure, the projection 32 will oppose itself in an elastic manner to the lateral displacement of the curve 26 in this direction. There results a supplemental retention force which adds to the release threshold of the retention element for this direction of displacement of the sole.

On the other hand, for a displacement in the other direction, the sole can be laterally displaced with respect to the jaw without the assembly formed by the curve and the projection opposing this movement. For this direction of displacement, the boot need overcome the release threshold of the retention element to be released.

The fact of having a lateral grip of the boot through the vamp, and having the curve on the sole is preferably because as a result the curve does not in any way disturb the lateral release of the boot.

In a manner so as to further protect the knee for a rotation of the foot towards the interior, the curve 26 is positioned on the left side of the sole, i.e., as shown in FIG. 1, for a left boot, and conversely it is positioned in a symmetrical fashion on the right side of the sole for a right boot. In this way, the release of the boot is made easier on the exterior side of the retention element than on the interior side thereof.

For each of the boots, this effect is obtained regardless of whether one or the other of the retention elements of the pair of skis is used. In other words, a reference of these retention elements as being a right or left element is unnecessary, and a reversal of the retention elements is of no consequence.

Preferably, projection 32 has no particular influence on a conventional boot, i.e., if a standard boot is engaged in the retention element. In this case, the projection acts like a traditional central support. Its elastic mobility can preferably facilitate the support of the boot in the jaw at three distance points, such as is described for example in published French patent application 2,463,629, the disclosure of which is hereby incorporated by reference thereto.

If boot 1, which can be referred to as a special boot, is utilized with a conventional binding element, i.e., adapted to function with a standard boot, the presence of the curve 26 does not disturb the linkage between the jaw and the boot other than that the curve of the shoe risks interfering with the central support or the wings of the jaw.

To overcome this effect, it is possible to form the boot tips in an interchangeable manner, and to replace the special tip by a conventional tip.

Figure 3:
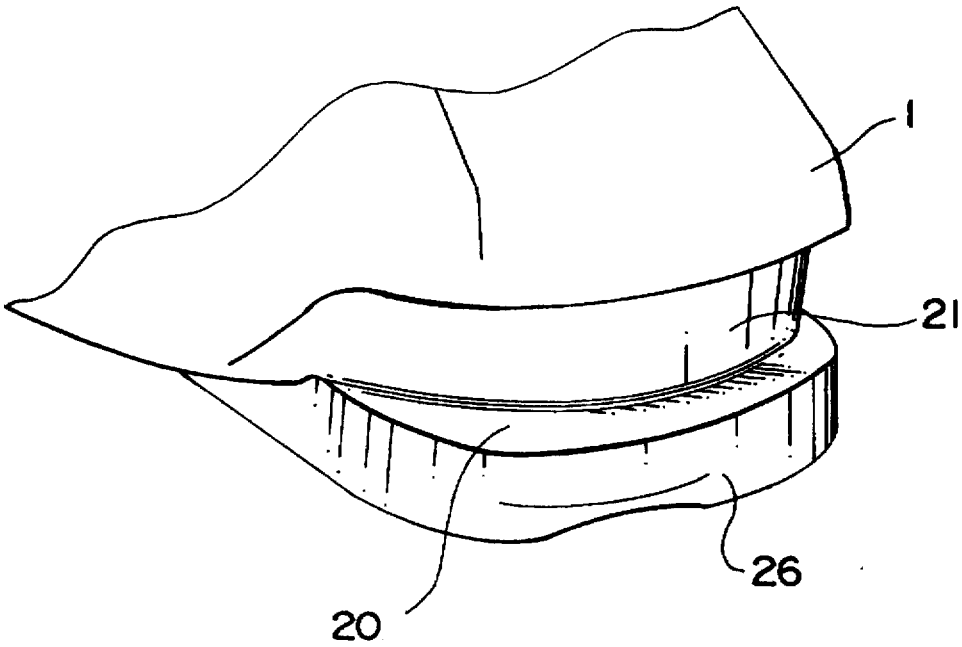
FIG. 3 is a partial view in perspective from the front of the boot shown in the preceding figures.

Another possibility is illustrated in FIG. 3. Instead of curve 26 coming from a localized elongation on the left side of the sole, this curve is obtained by local reduction or diminution on the right side of the sole, which produces substantially the same effect. Furthermore, the reduction occurs over only a lower portion of the height of the sole, while over the remaining upper portion, the sole maintains the symmetrical contour of a traditional standard sole. The projection 32 would be adapted in this case to carry over only the lower portion of the sole.

Thus, if the special boot is engaged in a traditional element, it is the upper portion of the sole which would furnish the necessary support. The lower portion of the sole will produce nevertheless an asymmetry of the release thresholds with a retention element adapted for this.

Alternatively, projection 26 could have a roller or any other means adapted to facilitate the relative displacement of the sole of the boot.

According to another embodiment, instead of being carried by the jaw, the projection 32 could be carried by the body of the retention element, and reach the sole under the jaw.

Figure 4:
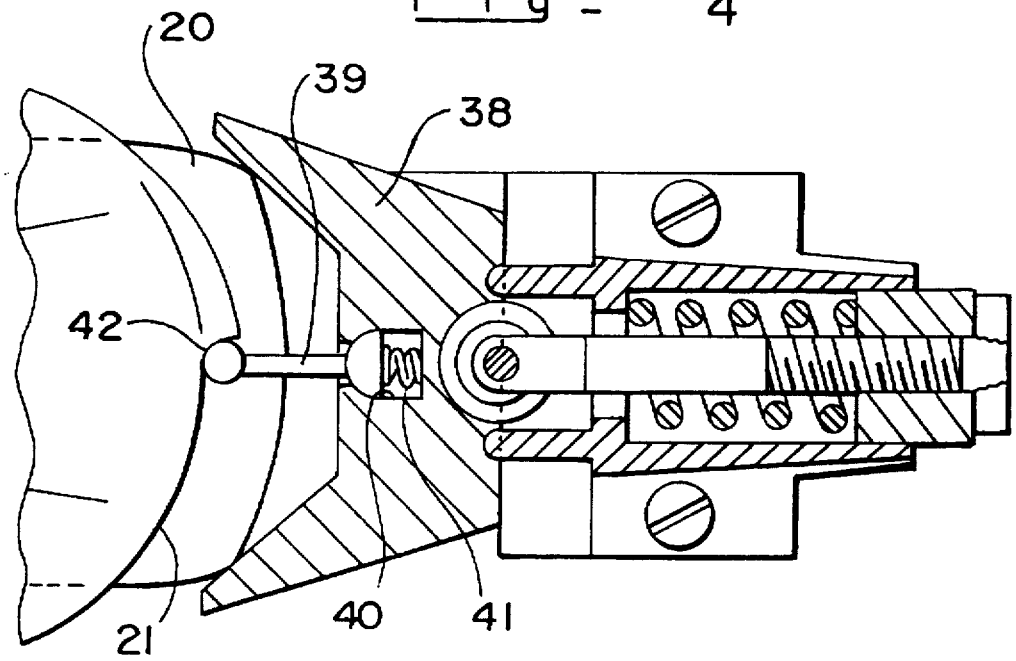
FIG. 4 illustrates a top view and in partial cross section the front of a boot and a retention element according to another way of performing the invention.

FIG. 4 shows an alternative way of performing the invention. According to this alternative, the retention element is of the same type as the preceding element, apart from the fact that the retention jaw 38 retains the boot laterally by a grip on the sole.

At the height of the vamp, jaw 38 has a finger 39. The finger 39 is oriented towards the rear. Its space in the form of a half sphere is seated in a seat 40 of the jaw. A spring 41 elastically returns the finger to a position which is aligned with a longitudinal and horizontal direction. The finger can oscillate elastically around this position against the return force opposed by the spring. If desired, the spring carries a roller at its rear end.

The boot itself has in the vicinity of the median plane a small shoulder 42 which is adapted to cooperate with the finger 39. The shoulder is for example obtained by a progressive deformation of the vamp over a portion of its contour ending in the shoulder.

The length of the finger is selected such that the rear end of the finger is engaged against shoulder 42 when the boot is located in the jaw in the center position.

Figure 6:
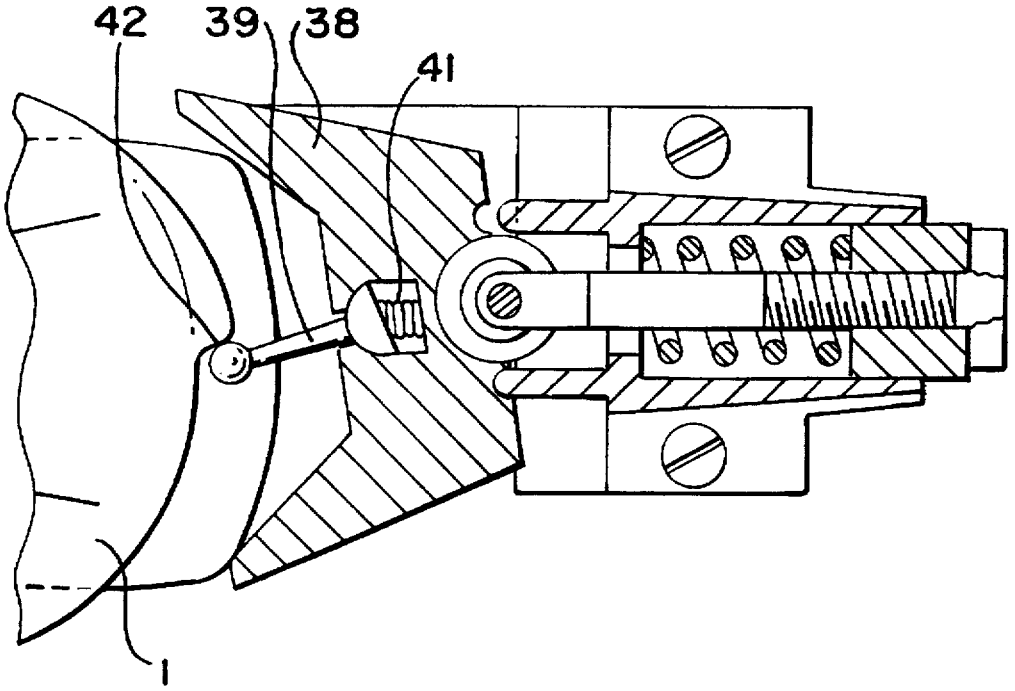
FIG. 6 illustrates the operation of the assembly shown in FIG. 4.

FIG. 6 shows the boot biasing the jaw 38 in a direction where its shoulder 42 moves with it the end of finger 39. Finger 39 is off axis relative to the alignment of the jaw, which causes a compression of spring 41. Under these conditions, to be released in this direction of bias, the boot must overcome the return force of finger 39 in addition to the release threshold of the retention element. After release of the boot, the jaw and the finger come back to a centered position, under the action of their respective return springs.

In other directions of bias, the shoulder can be freely displaced without moving the finger. To be freed, the boot must only overcome the release threshold of the retention element. Thus, if one equips a left boot with a shoulder such as shoulder 42, the boot will be more easily released for a torsional bias of the leg going towards the interior of the foot then in the other direction, towards the exterior of the foot. Naturally, the right boot would be equipped with a symmetrical shoulder.

The right and left retention elements are however identical, and they can be reversed without consequence relating to the operation of the assembly.

Preferably, if a standard boot is engaged in the retention element of FIG. 6, finger 39 will not be moved either in the direction of bias, or in the other. In this case, a boot will be released in the same manner in the two directions of bias.

Figure 5:
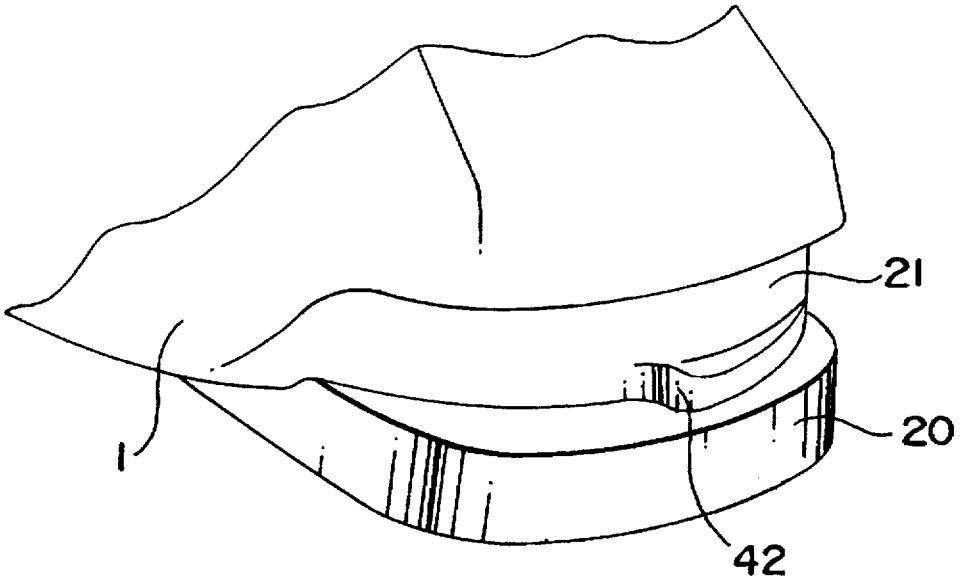
FIG. 5 is a partial perspective view of the front of the boot shown in FIG. 4.

If the special boot of FIG. 5 is engaged in a traditional retention element, the presence of the shoulder will not disturb the linkage between the jaw and the boot except if the element retains the boot by a vamp clip. To avoid this, it is possible to mount the shoulder on a front tip of the jaw interchangeable with a standard tip. Another possibility is to raise shoulder 42 the length of the vamp, above the standardized zone of the vamp, which, according to the standard ISO 5355, extends until 14 millimeters above the sole. In this manner, the shoulder will be totally outside the standardized zone with which cooperate in principal all of the present retention elements. Finger 39 would be lifted in the same manner.

According to a variation, finger 39 can be carried not by the jaw but by the binding element.

FIGS. 7–10 relate to another embodiment for performing the invention. According to this embodiment, the retention element has for example a structure with a jaw carried by the body, and a body mounted on a pivot. The body is movable around the pivot, against the elastic return force developed by a spring. This construction is known for the most part from published French Patent Application No. 2517214, the disclosure of which is hereby incorporated by reference thereto. This element will not be described in any further detail, and as will appear from what follows, numerous other types of constructions may likewise be used.

Figure 7:
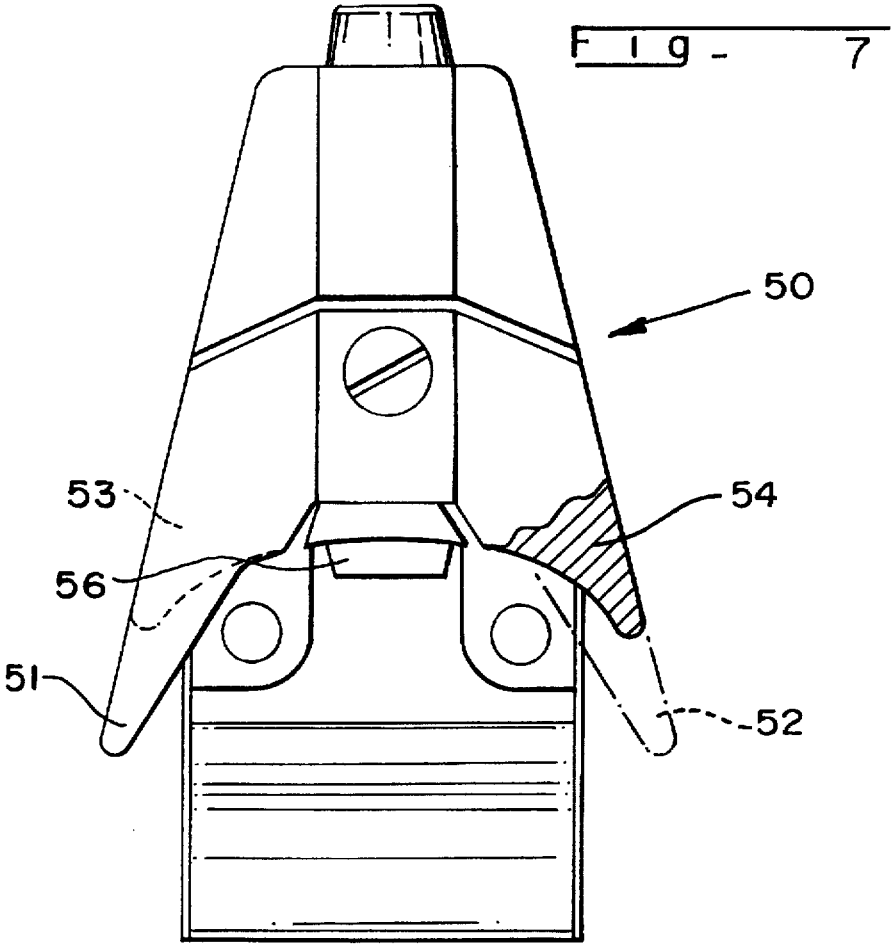
FIG. 7 shows in top view a retention element according to another way of performing the invention.
Figure 8:
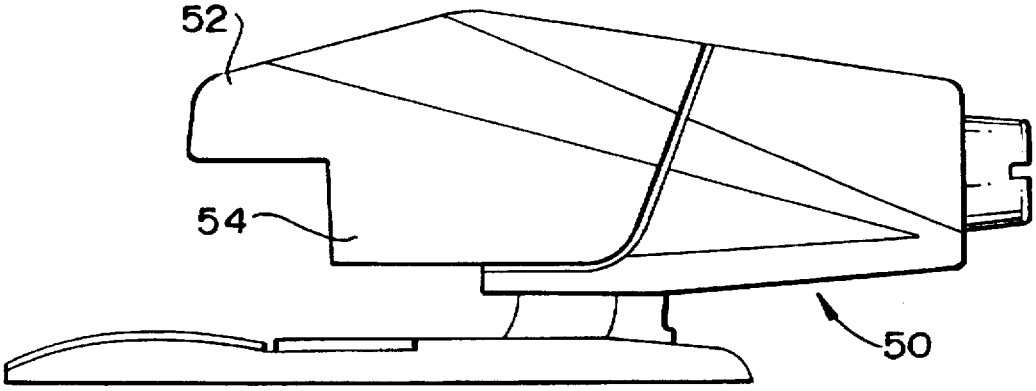
FIG. 8 is a side view of the retention element of FIG. 7.

The special aspect of the retention element 50 of FIGS. 7 and 8 is that the jaw has two superimposed stages, the upper stage being provided for a grip on the vamp of the boot, the lower stage being provided for a grip of the sole. Thus, the jaw of element 50 has two upper wings 51 and 52 provided for a grip of the upper, and two lower wings provided for a grip of the sole. Wings 51 and 53, 52 and 54 positioned on the same side are, for example, monoblock. Furthermore, the opening of the wings can be adjustable. The jaw can have furthermore a simple support 56 formed in a traditional manner.

The wings of a stage are relatively shortened with respect to the wings of the other stage, in a manner such that the lever arm with which the wings transmit to the spring the bias of the boot are smaller with the wings of one stage than with the wings of the other, and that, as a result, one obtains a release of the boot which is relatively easier with one stage than with the other.

For example, as it is illustrated, it is the lower wings 53 and 54 which operate by a grip on the sole which are shorter than the upper wings 51 and 52.

Figure 9:
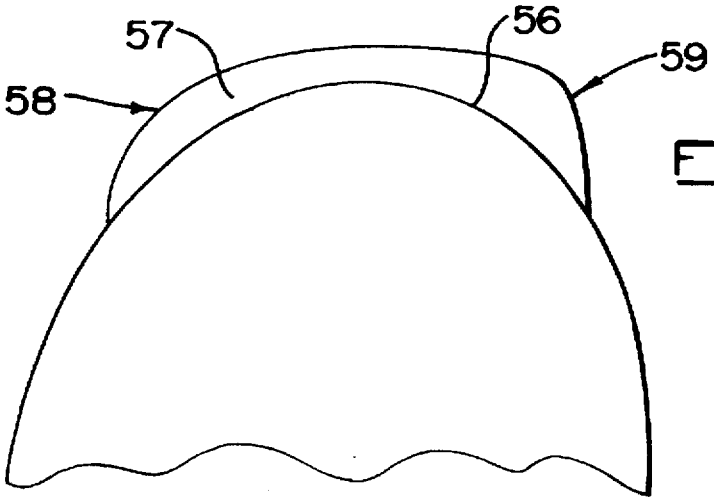
FIG. 9 is a top view of the front end of a boot adapted to cooperate with the retention element of FIG. 8.

The front of a special boot provided to cooperate with the retention element is shown in FIG. 9. This boot has a front tip with a traditional upper portion 56. The sole portion 57 has however a localized asymmetry. Thus, the sole is reduced on one of the lateral edges 58. Preferably, the other lateral edge 59 is slightly extended or laterally accentuated with respect to a portion of a traditional sole.

Figure 10:
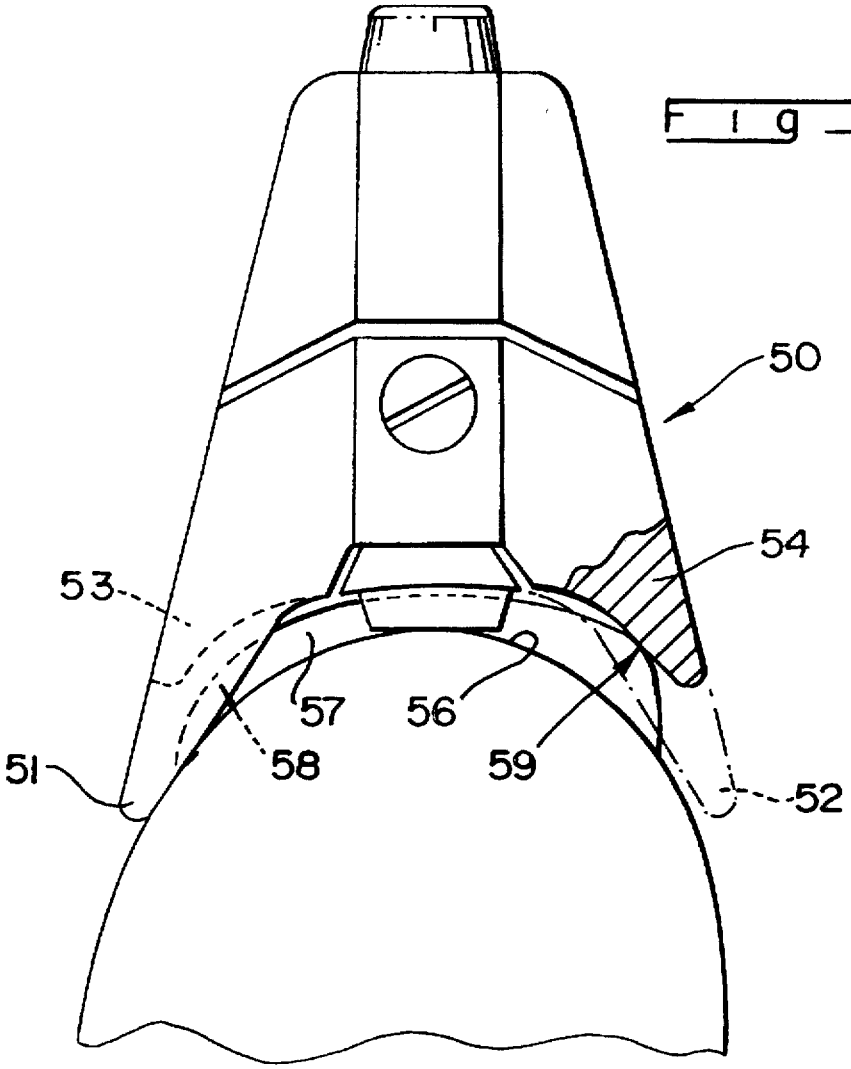
FIG. 10 shows in top view the front portion of the boot engaged in the retention element.

FIG. 10 shows the front of the boot engaged in the retention element 50. From the side of reduced edge 58 of the sole, the boot bears on wing 51 of the upper stage through a support on the vamp. On the other side, the boot bears on wing 54 of the lower stage through a support on the sole. Edge 59 has been accentuated on this side to space upper wing 52 from the vamp, and to avoid on this side a double support.

From what has preceded, it is understood that from the side of edge 59, the boot will be freed more easily, because it is retained by a shorter wing 54, and that the sole which is retracted on this side has no linkage with wing 52. For a release on the side of edge 58, the situation is different, the boot carries by virtue of the sole on wing 51 which operates in a traditional manner. The boot will thus be released more easily from one side than the other by virtue of its localized asymmetry which makes it carry on one wing which is shorter than the jaw. Taking into account that which has been described, the boot shown in FIGS. 9 and 10 will be a right boot. The left boot has in this case a tip whose shape is symmetrical with that of the tip shown. The retention element on the other hand is compatible with each of the two boots, and has a symmetrical structure.

If a standardized boot is engaged in retention element 50, it will rather bear on wings 51 and 52 of the upper stage which have not been shortened. The release of the boot will occur under the same conditions in the two directions of bias.

If the boot of FIG. 9 is engaged in a traditional retention element, there will be no major disturbance if the element is of the vamp grip type. If the element is of the sole grip type, an adjustment of the retention element will be necessary. Taking into account the asymmetrical form of the sole portion, it is probable that the release of the boot will not be symmetrical.

To avoid any disturbance, it is also possible to provide a tip with an interchangeable sole portion, in a manner so as to exchange part 57 with a part of traditional shape.

This embodiment is open to numerous variations. In the first place, it would be possible to shorten upper wings 51 and 52 rather than lower wings 53 and 54, so as to have a nominal vamp grip, and a weaker sole grip.

For a boot, the vamp portion would be asymmetrical and the sole portion would be symmetrical.

Another possibility comprises acting on the manner in which the wings envelop the boot tip.

Figure 12:
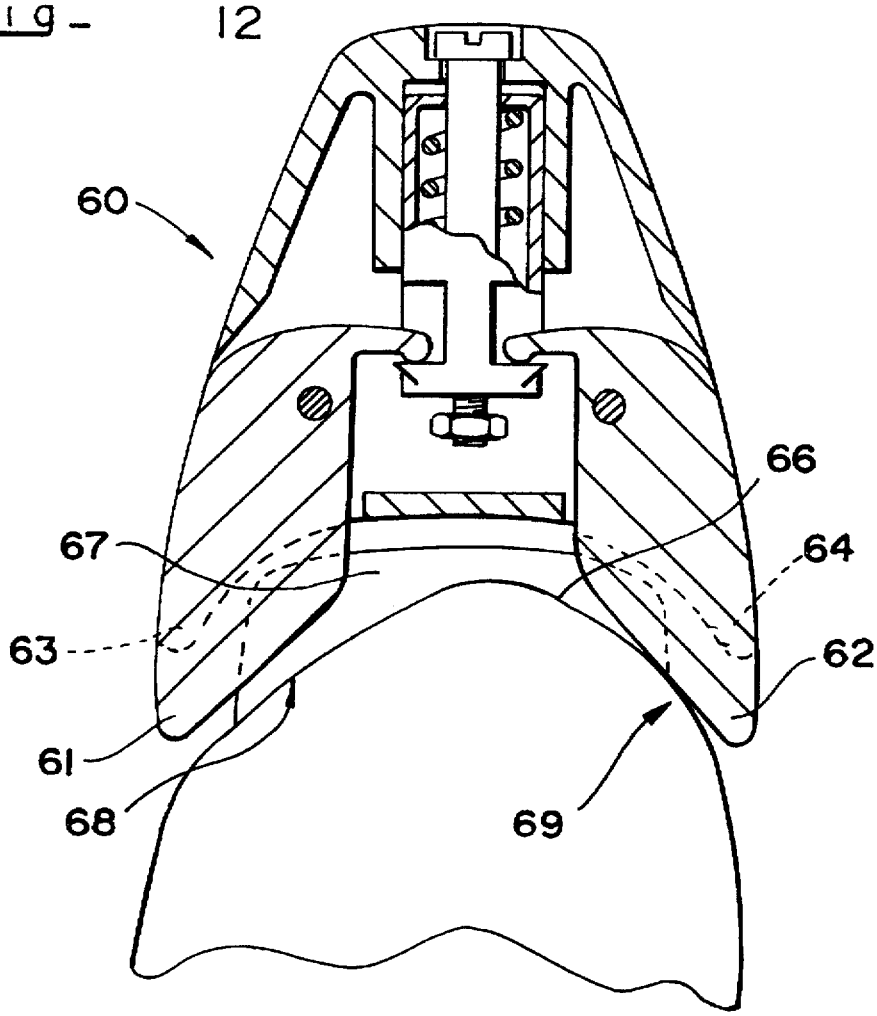
FIGS. 11 and 12 relate to alternative embodiments.
Figure 11:
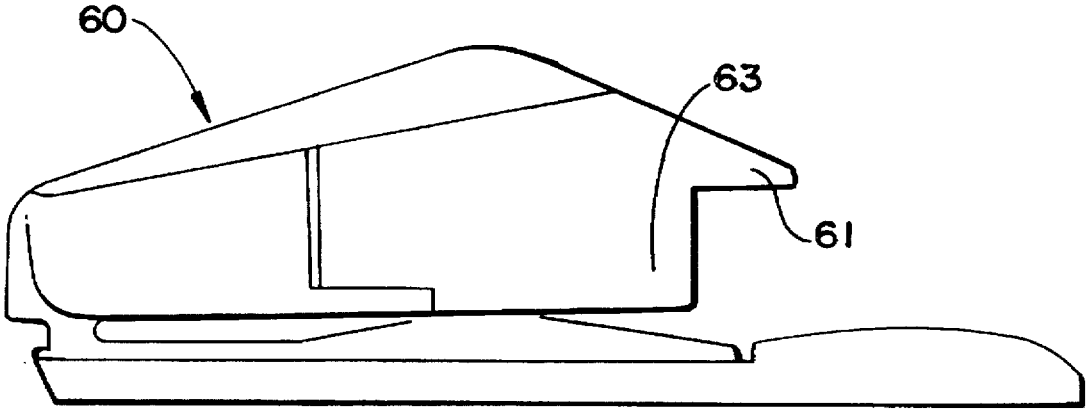

FIGS. 11 and 12 show such a variation. The retention element 60 shown is of the type having a fixed body and the jaw having independent retention wings. Its structure is essentially known from French Patent Application No. 2640516, the disclosure of which was previously incorporated by reference.

According to FIGS. 11 and 12, the element has two wing stages, an upper wing stage 61 and 62, adapted for a vamp grip of the boot, and a lower stage 63, 64 adapted for a sole grip.

The boot has a front tip with a sole portion 67 of symmetrical shape. The vamp portion 66 has been modified for a reduced zone 68.

Upper wings 61 and 62 envelop the vamp in a more pronounced fashion than the lower wing 63 and 64, such that the release of the boot by the sole grip is easier than by the vamp grip.

Here, the lever arm of the upper wings 61 and 62 remains greater than that of the lower wings 63 and 64, but the upper wings 61 and 62 are relatively longer and more enveloping than the lower wings, i.e., so as to release the boot they must be opened by a greater angle than wings 63 and 64.

Reduced zone 68 is adapted such that on the side of the vamp, the boot carries on the jaw through the sole. On the other side, the boot carries on the jaw by the other non-modified zone 69 of the vamp.

The boot is more easily freed from the side of the reduced zone 68 than from the side of zone 69.

The boot of FIG. 12 is a left boot. The right boot carries a reduced zone on the right of its vamp.

If a traditional boot is engaged in the retention element of FIGS. 11 and 12, it will be free with the same release threshold on both sides.

The special boot of FIG. 12 can furthermore be engaged in a standard retention element having a sole grip in the same manner as a normal boot, without changing the release thresholds.

If the retention element is a vamp grip, an adjustment of the opening of the wings will without doubt be necessary. Furthermore, the boot will without doubt release towards the exterior of the ski more easily than towards the interior, which goes in the direction sought.

Other variations are also possible. For example, it would also be possible to transpose the asymmetrical zone of the boot and the stage of the jaw which cooperates with it beyond the standardized zone of the boot, for example on the vamp beyond a distance of 14 millimeters from the sole which corresponds to the standardized zone. Thus, the boot would be totally compatible with traditional retention elements.

Furthermore, the retention element is not limiting, and other structures of retention element may be used, and in particular, an element having a fixed body and independently movable wings such as described for example in French Patent Application No. 2640516, a retention element having a fixed body and movable wings connected by a cross bar, such as is described for example in French Patent Application No. 2625911, the disclosures of which is hereby incorporated by reference. Other types of elements likewise are possible.

The instant application is based upon French patent application 94.08943, filed Jul. 13, 1994, the priority of which is hereby claimed under 35 U.S.C. §119, and the disclosure of which is hereby expressly incorporated by reference thereto.

More generally, although the invention has been disclosed with reference to particular means, materials and embodiments, it is to be understood that the invention is not limited to the particulars disclosed and extends to all equivalents within the scope of the claims.

What is claimed is:

1. An assembly of a boot and a retention device for a boot on a gliding board, said assembly comprising:

a boot comprising an end having a tip extending on each side of a longitudinal vertical median plane of said boot, said tip having a local asymmetrical portion;

a retention device adapted to be affixed to the gliding board, said retention device comprising:

a retention jaw having a construction adapted to engage said tip of said boot in a retention position in alignment with a longitudinal vertical median plane of said retention device;

a return spring operatively connected to said retention jaw to bias said jaw to said retention position, said jaw being supported for movement from said retention position against a return force of said return spring in response to movement of said tip of said boot laterally in a direction toward one or the other side of said longitudinal vertical median plane of said retention device from said retention position of said jaw to a release position upon a force exerted by said tip of said boot equal to or greater than a release threshold force;

a symmetric elastic retention mechanism adapted to cooperate with said local asymmetric portion of said boot for causing said release threshold force to have an increased magnitude for release of said boot upon lateral movement in a direction toward said one side of said longitudinal vertical median plane of said retention device with respect to a direction toward said other side of said longitudinal vertical median plane of said retention device.

2. An assembly according to claim 1, wherein:

said boot comprises a sole, said end of said boot comprising a front end of said sole; and said local asymmetric portion of said boot comprises a shape extending in relief from said front end of said sole.

3. An assembly according to claim 1, wherein:

said boot comprises a sole, said end of said boot comprising a front end of said sole; and said local asymmetric portion of said boot comprises a recessed portion of said front end of said sole.

4. An assembly according to claim 1, wherein:

said boot comprises a vamp, said end of said boot comprising a front end of said vamp; and said local asymmetric portion of said boot comprises a shape extending in relief from said front end of said vamp.

5. An assembly according to claim 1, wherein:

said boot comprises a vamp, said end of said boot comprising a front end of said vamp; and said local asymmetric portion of said boot comprises a recessed portion of said front end of said vamp.

6. An assembly according to claim 1, wherein:

said symmetric elastic retention mechanism comprises:

an element adapted to engage said asymmetric portion of said boot; and at least one spring for biasing said element for movement independent of said retention jaw.

7. An assembly according to claim 1, wherein:

said symmetric elastic retention mechanism comprises an element fixed for movement with said retention jaw.

8. An assembly according to claim 1, wherein:

said retention jaw and said symmetric elastic retention mechanism collectively comprise a pair of upper wings for engagement with a vamp of said boot and a pair of lower wings for engagement with a sole of said boot.

9. An assembly according to claim 8, wherein:

said upper wings and said lower wings have different respective lengths.

10. An assembly according to claim 8, wherein:

said upper wings are longer than said lower wings.

11. An assembly according to claim 8, wherein:

said upper wings envelop said vamp of said boot more than said lower wings envelop said sole of said boot.

12. An assembly according to claim 1, wherein:

said tip of said boot is interchangeable with another tip.

13. A retention device for use with a boot on a gliding board, the boot having an end with a tip extending on each side of a longitudinal vertical median plane of said boot, said tip having a local asymmetrical portion, said retention device comprising:

a retention jaw having a construction adapted to engage the tip of the boot in a retention position in alignment with a longitudinal vertical median plane of said retention device;

a return spring operatively connected to said retention jaw to bias said jaw to said retention position, said jaw being supported for movement from said retention position against a return force of said return spring in response to movement of the tip of the boot laterally in a direction toward one or the other side of said longitudinal vertical median plane of said retention device from said retention position of said jaw to a release position upon a force exerted by the tip of the boot equal to or greater than a release threshold force;

a symmetric elastic retention mechanism adapted to cooperate with the local asymmetric portion of the boot for causing said release threshold force to have an increased magnitude for release of the boot upon lateral movement in a direction toward said one side of said longitudinal vertical median plane of said retention device with respect to a direction toward said other side of said longitudinal vertical median plane of said retention device.

14. A retention device according to claim 13, wherein:

said jaw comprises a seat; and said symmetric elastic retention mechanism comprises:

an element mounted in said seat of said jaw, said element being located along said longitudinal vertical median plane of said retention device, said element being adapted to engage the asymmetric portion of the boot; and at least one spring for biasing said element for movement longitudinally independent of said retention jaw.

15. A retention device according to claim 14, wherein:

said jaw is adapted to engage a front end of a boot; and said element is biased by said at least one spring for rearward longitudinal movement.

16. A retention device according to claim 13, wherein:

said symmetric elastic retention mechanism comprises:

a finger longitudinally extending in a centered position along said longitudinal vertical median plane of said retention device, said finger being mounted for movement out of said centered position; and a spring for elastically returning said finger to said centered position.

17. A retention device according to claim 13, wherein:

said retention jaw and said symmetric elastic retention mechanism collectively comprise a pair of upper wings for engagement with a vamp of the boot and a pair of lower wings for engagement with a sole of the boot.

18. A retention device according to claim 17, wherein:

said upper wings and said lower wings have different respective lengths.

19. A retention device according to claim 18, wherein:

said upper wings are longer than said lower wings.

20. An assembly according to claim 17, wherein:

said upper wings are adapted to envelop the vamp of the boot more than the lower wings envelop the sole of the boot.

21. A boot for use with a retention device on a gliding board, the retention device having a retention jaw with a construction adapted to engage a tip of and end of the boot in a retention position in alignment with a longitudinal vertical median plane of the retention device, and a return spring operatively connected to the retention jaw to bias the jaw to the retention position, the jaw being supported for movement from the retention position against a return force of the return spring in response to movement of the tip of the boot laterally to one or the other side of the longitudinal vertical median plane of the retention device from the retention position of the jaw to a release position upon a bias exerted by the tip of the boot equal to or greater than a release threshold force, said boot comprising:

said end having said tip, said tip extending on each side of a longitudinal vertical median plane of said boot; and said tip having a local asymmetrical portion.

22. A boot according to claim 21, wherein:

said local asymmetrical portion comprises a curved surface immediately adjacent a longitudinal vertical median plane of said boot.

23. A boot according to claim 21, wherein:

said local asymmetrical portion comprises a shoulder immediately adjacent a longitudinal vertical median plane of said boot.

24. A boot according to claim 21, wherein:

said boot further comprises a sole; and said local asymmetrical portion comprises a recessed portion on a lateral edge of said sole of said boot.

25. A boot according to claim 21, wherein:

said boot further comprises a vamp; and said local asymmetrical portion comprises a recessed portion on one side of said vamp of said boot.

26. A pair of boots comprising a first boot and a second boot, each of said pair of boots comprising a boot according to claim 21, wherein said tip of said first boot is symmetric to said tip of said second boot.

* * * * *